US007955015B2

(12) United States Patent
Albisetti et al.

(10) Patent No.: US 7,955,015 B2
(45) Date of Patent: Jun. 7, 2011

(54) DEVICE FOR APPLYING A PRODUCT

(75) Inventors: Nicolas Albisetti, Clichy (FR); Aline Abergel, Boulogne (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 11/802,483

(22) Filed: May 23, 2007

(65) Prior Publication Data

US 2007/0292194 A1 Dec. 20, 2007

Related U.S. Application Data

(62) Division of application No. 10/784,572, filed on Feb. 24, 2004, now abandoned.

(60) Provisional application No. 60/451,256, filed on Mar. 4, 2003.

(30) Foreign Application Priority Data

Feb. 24, 2003 (FR) ..... 03 02236

(51) Int. Cl.
*A46B 11/00* (2006.01)

(52) U.S. Cl. ..... 401/123; 401/125; 401/127

(58) Field of Classification Search ..... 401/123–125, 401/127

See application file for complete search history.

(56) References Cited

U.S. PATENT DOCUMENTS

| | | | |
|---|---|---|---|
| 1,512,799 | A | 10/1924 | Reid |
| 2,214,437 | A | 9/1940 | Punte et al. |
| 2,215,480 | A | 9/1940 | Sampson |
| 2,236,240 | A | 3/1941 | Lowen |
| 2,783,875 | A | 3/1957 | Shabarick |
| 2,951,489 | A | 9/1960 | Roberts |
| 3,397,707 | A | 8/1968 | Aversa |
| 3,503,089 | A | 3/1970 | Coneway |
| 3,760,820 | A | 9/1973 | Seidler |
| 4,579,133 | A | 4/1986 | Seidler |
| 4,679,692 | A | 7/1987 | Davey |
| 4,726,387 | A | 2/1988 | Sarica |
| 4,777,969 | A | 10/1988 | Holloway |
| 5,135,112 | A | 8/1992 | Kamen et al. |
| D333,535 | S | 2/1993 | Kamen et al. |
| 5,205,301 | A | 4/1993 | Nakamura |
| 5,437,294 | A | 8/1995 | Ebbets, III et al. |
| 5,655,553 | A | 8/1997 | Giese et al. |
| 6,002,651 | A | 12/1999 | Baccaray |

(Continued)

FOREIGN PATENT DOCUMENTS

| | | |
|---|---|---|
| EP | 0 261 750 | 3/1988 |
| EP | 0 960 582 | 12/1999 |
| EP | 1 020 135 | 7/2000 |
| EP | 1 118 286 | 7/2001 |

(Continued)

*Primary Examiner* — Tuan N Nguyen
(74) *Attorney, Agent, or Firm* — Finnegan, Henderson, Farabow, Garrett & Dunner, LLP

(57) ABSTRACT

A device for applying a product may include a container configured to contain a product and a case with a compartment configured to receive the container. The case may define an opening and the container may be configured to be moved relative to the case between a first angular position in which product in the container is accessible via the opening, and a second angular position in which product in the container is inaccessible. The device may further include an applicator. In some examples, the applicator may include a first portion configured to contribute to restricting axial movement of the applicator with respect to the case, and a second portion distinct from the first portion, wherein the second portion may be configured to contribute to rotationally coupling the applicator to the container so that movement of the applicator causes movement of the container between the first and second angular positions.

5 Claims, 4 Drawing Sheets

U.S. PATENT DOCUMENTS

| | | | |
|---|---|---|---|
| 6,073,634 | A | 6/2000 | Gueret |
| 6,309,124 | B1 | 10/2001 | Gueret |
| 6,726,387 | B2 | 4/2004 | Dumler et al. |
| 6,874,966 | B2 | 4/2005 | Duqueroie et al. |
| 7,163,016 | B2 | 1/2007 | Kingsford et al. |
| 7,168,435 | B2 | 1/2007 | Vieu et al. |
| 2001/0032656 | A1 | 10/2001 | Kingsford et al. |
| 2002/0108629 | A1 | 8/2002 | Thiebaut |

FOREIGN PATENT DOCUMENTS

| | | |
|---|---|---|
| FR | 1 020 647 | 2/1953 |
| FR | 2 759 872 | 8/1998 |
| GB | 2 139 886 | 11/1984 |
| JP | S60-103409 | 7/1985 |
| JP | S63-202208 | 12/1988 |
| JP | H4-56415 | 5/1992 |
| JP | A 2002-262936 | 9/2002 |

DEVICE FOR APPLYING A PRODUCT

This is a divisional of application Ser. No. 10/784,572, filed Feb. 24, 2004 now abandoned, which is incorporated herein by reference, and claims benefit of priority under 35 U.S.C. §119(e) of U.S. provisional application No. 60/451,256, filed Mar. 4, 2003; additionally, this application claims priority to French application no. 0302236 filed Feb. 24, 2003.

BACKGROUND OF THE INVENTION

1. Field of the Invention

The present invention relates to devices for application of at least one product. In some examples, there may be a device having a case with a principal extension axis, an applicator that can be fitted in a storage position of the case, and a container containing the product, the container being accommodated at least partially in the case. The case may have at least one lateral opening through which the product can be withdrawn using the applicator.

2. Description of the Related Art

European Patent Application No. EP-A2-1 118 286 shows examples of devices in which a container containing a product to be applied is inserted into a housing of a case intended to hold the container. The devices also include an applicator that may be held to this case. In some of these known devices, the applicator is held on the case so that its detachment from the case causes the container to rotate in the case until the container is in a position making it possible to access to the product via the lateral opening of the case.

These known devices have an applicator of elongate shape having an outer perimeter bearing two lugs that are diametrically opposite with respect to the extension axis of the applicator. These lugs are of cylindrical shape and extend radially beyond this outer perimeter. The lugs have an axisymmetric shape with respect to an axis perpendicular to the principal extension axis of the applicator. The lugs protrude from the outer perimeter by a height that is sufficient to enable the lugs to engage in a helical slideway arranged on the container that is held in the case. This engagement enables the container to rotate in the case, by a simple rotation applied to the applicator relative to the case. The slideway has a double ramp in order to engage both of the lugs simultaneously.

Because these lugs are used for both engaging the container rotationally relative to the case and for fitting the applicator on the case, the lugs at least sometimes require a significant height and diameter.

In at least some examples, the known devices may have a drawback in that the lugs arranged on the perimeter of the applicator are unsightly. In order to resolve this issue, a cap at the end of the applicator may have walls for concealing the lugs and for covering the outer perimeter of the applicator. If a cap is provided, however, it may be desired to increase the length of the case in order to obtain an applicator with a tip arranged at a sufficient distance from the cap for correct application of the product. The lengthened case then becomes bulky.

After using the applicator to apply a product, a user replaces the applicator in the case by engaging the two lugs in their respective ramps. Owing to their protruding cylindrical shape, however, the lugs can initially slip and slightly displace the container before engaging their respective ramps. If the user then rotates the displaced container slightly inside the case, the applicator may be prevented from being correctly fitted on the case and may lead to increasingly poor availability of the product via a lateral opening of the case.

For these and other reasons, there is a need for alternative approaches.

For example, there may be a desire to facilitate the manufacture of a device of the type summarised above and to make the device aesthetic. In some instances, it may be desired to have the portion used for fitting the applicator on the case separate from the portion for rotating the container relative to the case.

SUMMARY

In the following description, certain aspects and embodiments of the present invention will become evident. It should be understood that the invention, in its broadest sense, could be practiced without having one or more features of these aspects and embodiments. In other words, these aspects and embodiments are merely exemplary.

In at least some of the aspects, the present invention may limit or avoid one or more drawbacks of the related art.

According to one aspect, there may be a device for packaging and application of a product. The device may include a case forming a compartment intended to hold a container containing a product, a first opening which is formed in the case and through which, in a first angular position of the container relative to the case, the product can be withdrawn using an applicator. The container may be capable of occupying a second angular position relative to the case, in which the product is inaccessible via the first opening. The applicator may be fixed removably to the case. The applicator may include a first portion (e.g., means) contributing to axial immobilisation of the applicator inside the case, and a second portion (e.g., means), which is separate from the first portion, for contributing to rotational coupling of the applicator and of the container with a view to moving the container from the first angular position to the second angular position, and vice versa.

In another aspect, there may be a device for applying a product, wherein the device comprises a container configured to contain a product, and a case comprising a compartment configured to receive the container. The case may define an opening, and the container may be configured to be moved relative to the case between a first angular position in which product in the container is accessible via the opening, and a second angular position in which product in the container is inaccessible via the opening.

In some aspects, the device may include an applicator configured to be releasably coupled to the case.

In one aspect, the applicator may comprise a first portion configured to contribute to restricting axial movement of the applicator with respect to the case, and a second portion distinct from the first portion, the second portion being configured to contribute to rotationally coupling the applicator to the container so that movement of the applicator causes movement of the container between the first and second angular positions. In accordance with the meaning of the term "distinct from," as used herein, the first portion and the second portion "distinct from" the first portion are different from the configuration of the lugs disclosed in above-mentioned European Patent Application No. EP-A2-1 118 286.

In another aspect, the device may include at least one striation and at least one relief configured to cooperate with one another so as to rotationally couple the applicator and the container, and the device may be configured so that movement of the applicator causes movement of the container between the first and second angular positions. For example, the applicator may comprise a portion (e.g., the second portion) comprising the at least one striation. In some examples, the device may comprises a transmission member comprising the at least one relief.

In yet another aspect, the device may include a transmission member distinct from the container (e.g., the transmission member and the container are not defined by a single, integral piece of material). The transmission member may be received in the case, and the transmission member and the container may be configured to be rotationally coupled to one another. The device may also include an applicator comprising a portion configured to be rotationally coupled to the transmission member so that movement of the applicator causes movement of the container between the first and second angular positions. In some examples, the device may comprise a tab and at least one groove rotationally coupling the transmission member and the container to one another.

In a further aspect, the case may comprise a screw thread and the applicator may comprise a screw thread configured to engage with the screw thread of the case; and the device may be configured so that so that movement of the applicator causes movement of the container between the first and second angular positions. In some examples, the applicator may comprises a skirt, the screw thread of the applicator may comprise an inner screw thread on the skirt, and the screw thread of the case may comprise an outer screw thread. In other examples, the screw thread of the applicator may comprise an outer screw thread, and the screw thread of the case may comprises an inner screw thread.

In another aspect, the second portion may comprise at least one striation arranged on the applicator. In some examples the striation may be configured to cooperate with at least one complementary relief arranged on a transmission member. This cooperation may make it possible to convert a rotational movement of the applicator with respect to the case into a rotational movement of the container with respect to the case.

As used herein, the term "striation" is intended to mean a protuberance. In some examples, the striation is configured to be engaged in a complementary relief. For some embodiments, the striation may be formed on an outer perimeter of the applicator and intended to be engaged in a complementary relief, so as to make it possible to convert a rotational movement of the applicator with respect to the case into a rotational movement of the container with respect to the case. Alternatively, the striation may be defined by another part of the device, such as the transmission member. In some examples, the protuberance may have at least one edge parallel to a principal extension axis (e.g., longitudinal axis) of the case and/or a longitudinal axis of the applicator.

In at least one aspect, the at least one striation may form a dihedron.

In a further aspect, the second portion may includes at least two striations formed consecutively along the same radial arc, which is defined at the periphery of the outer perimeter of the applicator. For example, the radial arc may be less than 90°.

In another aspect, the second portion may include four striations distributed (e.g., regularly distributed) along the outer perimeter of the applicator.

In a further aspect, the second portion may include a section of the applicator including a plurality of striations along the entire outer perimeter of the section. The transmission member may also include a section including a plurality of complementary reliefs along the entire inner perimeter of the section of the transmission member for cooperating with the striations.

In some examples wherein the applicator includes a plurality of striations, the striations may have at least one edge parallel to the principal extension axis of the case, and the striations may be parallel to one another.

In another aspect, the case may be elongated and extend along a principal extension axis (e.g., longitudinal axis). In some examples, the applicator may be similar to a pen or a device having a mascara applicator.

In still another aspect, the opening is a first opening, the case may define a second opening, and the container may be configured to be inserted into the case through the second opening. For example, the container may be introduced into the into the case via the second opening while being translated along the case's principal extension axis in the direction of the compartment. In some exemplary arrangements, the second opening may be defined at one end of the principal extension axis In a further aspect, the applicator may be inserted (e.g., along the principal extension axis) in a third opening defined by the case, wherein the third opening may be distinct (e.g., separate) from the first and second openings. The third opening may be located opposite the second opening with respect to the case axis (i.e., the second and third openings may be located at opposite longitudinal ends of the case). In some examples, the third opening may be positioned at a second end of the case along the principal extension axis.

In yet another aspect, the position of the second portion along the applicator and relative to the principal extension axis may be arranged such that the applicator is rotationally coupled to the container when the first portion is already engaged and restricts axial movement of the applicator with respect to the case. For example, the second portion may have a length along the principal extension axis, such that, when the first portion implements a helical movement of the applicator relative to the case, the second portion remains rotationally engaged with complementary reliefs only for a predetermined number of turns of the applicator in the case. This may enable a user to accurately position the container with respect to the first opening, for opening or closing access to the product via the first opening.

In yet another aspect, the first portion may comprise a recess configured to cooperate with a protrusion for restricting axial movement of the applicator with respect to the case. In some examples arranged in such a manner, the device may include a portion (e.g., means) configured to limit the rotation of the applicator relative to the case when the recess and protrusion are engaged.

In at least one aspect, the second portion may be configured to allow the applicator to rotationally engage the container relative to the case only when the first portion has fully immobilized the applicator in the axial direction.

In a further aspect, the transmission member may be an intermediate piece. The intermediate piece may be configured to be connected to the container and bear a complementary relief configured to cooperate with the second portion, which may include at least one striation.

In some examples, the intermediate piece may be held freely in the case, for example, by cooperation of a screw thread, which is arranged on the inner perimeter of the case, with a helical groove (i.e., screw thread), which is arranged on the outer perimeter of the intermediate piece.

In another aspect, the intermediate piece may have at least one groove configured to cooperate with complementary reliefs arranged on the container, which may make it possible to index the position of the container relative to the case.

In another aspect, the container may comprises tabs and the transmission member may comprise at least one groove configured to cooperate with the tabs so as to rotationally couple the container and the transmission member.

In a further aspect, the transmission member may be an integral part of the container (i.e., a single, integral piece may define the transmission member and the container) and may extend from the cavity in which the product is contained.

In a further aspect, the applicator may be held to the case by a collar of the device which defines a protrusion cooperating with a recess formed on the applicator. Alternatively, the recess may be formed on the case and the collar defining a protrusion may be formed on the applicator.

In a further aspect, the applicator may include a skirt around the axis of the tip of the applicator, wherein the wall of this skirt may have a screw thread on its inner perimeter, thus defining a first portion configured to provide immobilization by cooperating with a complementary screw thread arranged on the case. For example, cooperation of the screw threads may hold the applicator to the case.

In an even further aspect, the first portion (e.g., a screw thread) may be arranged at a distal end of the second portion so that the second portion is in engagement in order to allow rotation of the container, for a predetermined number of turns of the first portion in a complementary portion (e.g., a complementary screw thread) arranged on the inner perimeter of the case.

In an even further aspect, the container may include a portion for being held in translation and free in rotation in the case. For example, the portion may be an elastic locking member.

In another aspect, the container and/or the transmission member may include a portion configured to limit rotation of the container in the case.

In a further aspect, the device may further comprise a product contained in the container and the product may be a cosmetic product. For example, the product may be a makeup product (e.g., mascara, lip makeup, blush, eye shadow, concealer, nail product, etc.)

In some examples, the applicator may be an applicator configured to withdraw product from the container via the first opening and to apply the product to at least one of skin, eyelashes, eyebrows, hair, and nails.

Yet another aspect may relate to a method for assembling a device for applying (and possibly also packaging) a product, wherein the device comprises a case, a transmission member, and an applicator, wherein the case comprises a first opening through which product is withdrawn using the applicator, and wherein the case comprises a second opening distinct from the first opening. The method may include coupling (e.g., assembling) the applicator to the case using a first portion of the applicator, engaging a second portion of the applicator with a relief (e.g., complementary relief) on the transmission member, and introducing a product container into the case through the second opening of the case, wherein the device assembled according to the method is configured so that engagement of the second portion with the relief enables rotational movement of the applicator with respect to the case to cause rotational movement of the container with respect to the case. In some examples, engagement of the second portion subsequent to the introduction of the container may make it possible to convert a rotational movement of the applicator with respect to the case into a rotational movement of the container with respect to the case.

In another aspect, the container may configured to rotate (e.g., freely) with respect to the case, and introducing a product container may comprises moving the product container along an axis of the case so as to couple the container to a portion configured to index a position of the container in relation to that of the applicator.

Aside from the structural and procedural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

DESCRIPTION OF A FEW EXEMPLARY EMBODIMENTS

Figure 1A:
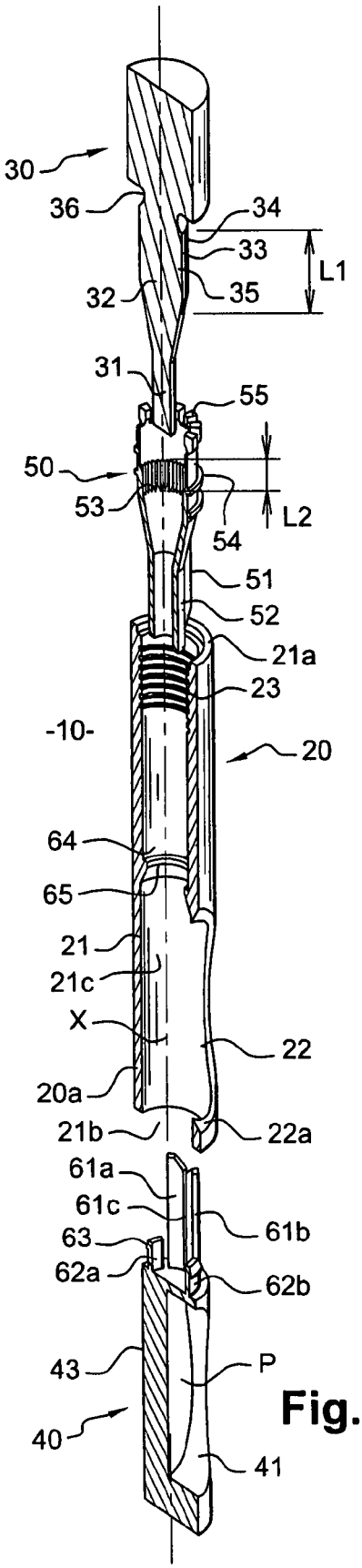
FIG. 1*a* shows an exploded sectional view of a device according to a first embodiment of the invention.

Reference will now be made in detail to a few exemplary embodiments of the invention. Wherever possible, the same reference numbers are used in the drawings and the description to refer to the same or like parts.

The application device 10, according to the embodiment represented in FIGS. 1 to 6, has a case 20 and an applicator 30 The applicator 30 may connect to case 20 when not applying product. In FIG. 1, the case 20 has an elongated shape along a longitudinal principal extension axis X (e.g., longitudinal axis) and a tubular body, which is open at two ends 21*a* and 21*b*. The two ends 21*a* and 21*b* are opposite with respect to the axis X. The body 21 may be made by injection moulding from a rigid and opaque thermoplastic material, for example.

The case 20 also has a lateral opening 22. FIG. 1 shows an embodiment of the device 10 with an opening 22 having a substantially oval shape. This opening 22 is defined, for example, in a slightly convex curved surface, which is hollowed towards the inside of the case 20. The opening 22 has, for example, a short side with an exemplary dimension between 0.5 and 1.5 cm and a long side with an exemplary dimension between 3 and 5 cm. In this embodiment, the opening 22 is made in a portion 20*a* that occupies, for example, slightly less than half of the body 21 near opening 21*b*. The side-edge 22*a* of the opening 22, which is adjacent to the opening 21*b*, may be separated from opening 22 by approximately 0.5 cm, for example, as illustrated in FIGS. 1 and 2.

The applicator 30 is intended to be fitted in the case 20 via the opening 21*a*. The applicator 30 (which is schematically illustrated) has an application element 31 at one end. Element 31 may be of any type, such as, for example, a thin brush, a flocked tip, an elastomer tip, or a foam The element 31 may also comprise a mascara brush or a comb for the eyelashes or the eyebrows. In the embodiment of FIGS. 1*a* and 1*b*, the application element 31 is arranged at the end of a rod 32, which is connected to a skirt by intermediate portion 33, the purpose of which is explained below.

As shown in FIG. 1*a*, a container 40 containing a product P (e.g., cosmetic product) may be accommodated in the case 20 by being fitted via the opening 21*b*. The device 10 is configured so as to allow a user to access the product P through a lateral opening 22 when the container 40 is in a first predetermined relative position with respect to the case 20.

The product P is, for example, a cosmetic or dermatological product. In some examples, the term "cosmetic product" may be a cosmetic product as defined by Directive 76/768/EEC as amended by Council Directive 93/35/EEC of Jun. 14, 1993.

The product P may, for example, be a compacted powder or have been poured into the container 40, or into a cup placed in the container 40, and solidified in it. The product P may be capable of fragmenting upon contact with a moistened application element. The product P may form a coherent mass. The product P may adhere to the wall of the housing that contains the product P.

In the exemplary embodiment corresponding to FIGS. 1 to 6, the container 40 is configured to rotate relative to the case 20 about the axis X, between at least one position in which an opening 41 of the container 40 is positioned beside the lateral opening 22 in order to allow a user to withdraw the product P, and at least one position in which the opening 41 of the container 40 is angularly offset, for example by one quarter of a turn, with respect to this lateral opening 22, making the product P inaccessible. A wall 43 axisymmetric about an axis X of the container 40 forms a shutter when positioned beside lateral opening 22.

Figure 1C:
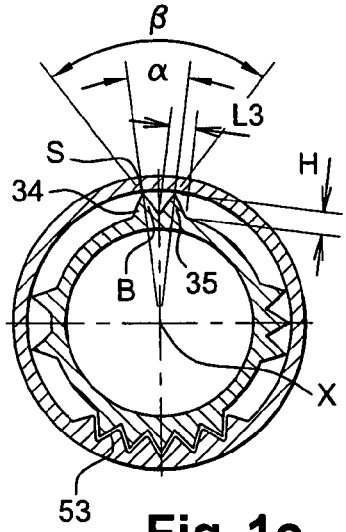
FIG. 1*c* shows a sectional view of a device according to FIG. 1*a*, when assembled.
Figure 1B:
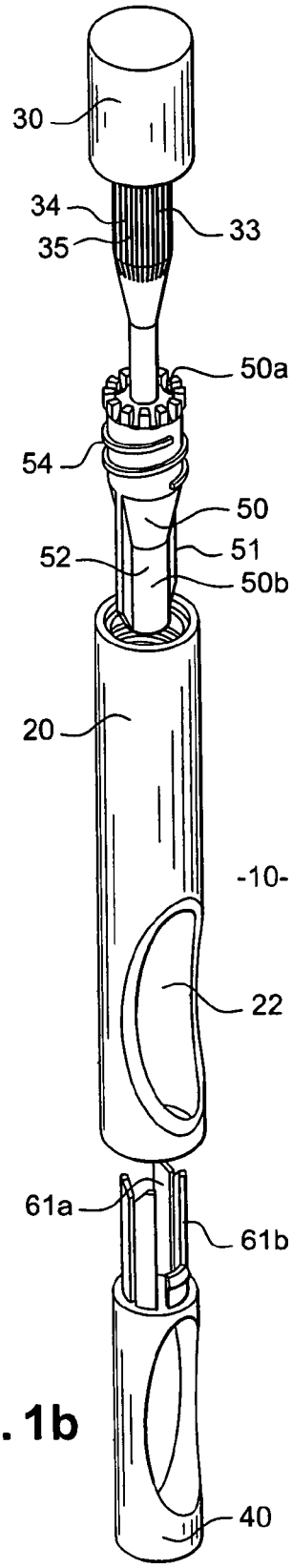
FIG. 1*b* shows an exploded view of a device according to FIG. 1*a;*
Figure 2:
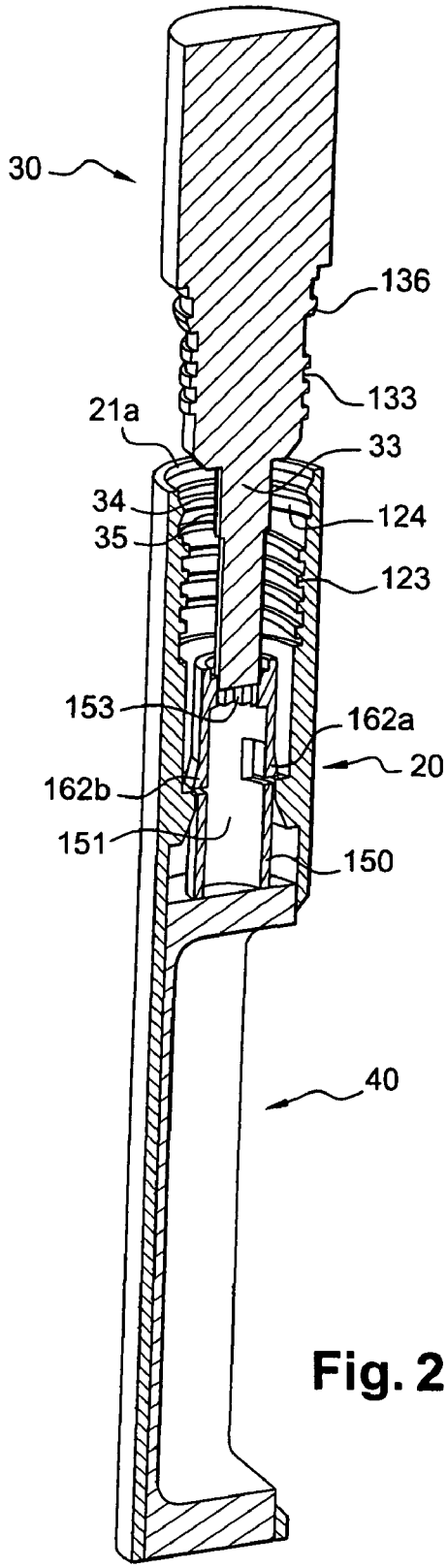
FIG. 2 shows an exploded sectional view of a device according to a second embodiment of the invention.

In the embodiment of FIGS. 1*a*, 1*b*, and 1*c*, the wall 43 of container 40 defines a cavity that may contain the product P, with opening 41 delimiting this cavity. The outer diameter of container 40 is selected so as to allow container 40 to fit inside the portion 20*a* of the case 20 with a relatively small clearance. Inner surface 21*c* of this portion 20*a* is axisymmetric about the axis X. The inside of the portion 20*a* forms a compartment for holding the container 40.

In the embodiment of FIGS. 1*a*, 1*b*, and 1*c*, it is the rotation of the container 40 that opens or closes lateral opening 22 for allowing access to the product P. This rotation is obtained by movement, about the axis X, of the applicator 30, which is rotationally coupled to container 40 by a transmission member 50.

In the embodiment illustrated in FIG. 1*b*, the transmission member 50 has a tubular body 51 around axis X and is open at a first end 50*a* in order to allow engagement with the application element 31, the rod 32, and the intermediate portion 33 of the applicator 30. A second end 50*b* of the transmission member 50, on the opposite side from the end 50*a* with respect to the axis X, is configured as so as allow the container 40 to be attached to the transmission member 50.

In the embodiment of FIGS. 1*a*, 1*b*, and 1*c*, the container 40 is provided with at least two fastening tabs 61*a* and 61*b* on the same side as the end intended to be inserted first into the case 20. These fastening tabs 61*a* and 61*b* are intended to cooperate with a groove 51, which is arranged on the outer perimeter 52 of the transmission member 50. The cooperation of the tabs 61*a* and 61*b* with the groove 51 makes it possible to obtain indexing and rotation of the container 40 relative to the case 20, when the transmission member 50 is fitted in this case 20. The container 40 and the transmission member 50 are thereby rotationally connected to each other.

In some examples, the tabs 61*a* and 61*b* define a space 61*c* between them in which the groove 51 may slide. These two tabs 61*a* and 61*b* may be joined in a region, which is diametrically opposite the space 61*c* intended to hold the groove 51. One side-face of these tabs 61*a* and 61*b* may be chamfered for defining a slope between the diametrically opposite region and the space 61*c* intended to hold the groove 51 The slope makes it possible to guide the groove 51 in the space 61*c* when the container 40 is assembled with the transmission member 50.

In the embodiment of FIGS. 1*a*, 1*b*, and 1*c*, the container 40 has two elastic tongues 62*a* and 62*b*, which may be diametrically opposite with respect to the axis X, for limiting translational movement of the container 40 within case 20 along the axis X. Each tongue 62*a* and 62*b* comprises a tooth 63, which can snap-fasten elastically into a corresponding hollow 64 arranged on an inner wall of the case 20. This hollow 64 is, for example, defined level with an annular shoulder 65 of the inner wall.

The container 40 may be inserted into the opening 21*b* of the case 20 by translation along the axis X, until the tongues 62*a* and 62*b* are snap-fastened onto the annular shoulder 65. If transmission member 50 is fitted in case 20, inserting container 40 into case 20 may engage groove 51 by translation between the two tabs 61*a* and 61*b*. The container 40 may have a second set of tabs, such as 61*a* and 61*b*, so as to tolerate at least two arrangement positions during fitting. The side-face of these tabs 61*a* and 61*b* may furthermore be chamfered in order to promote engagement with the groove 51, which may itself be bevelled, even if the space 61*c* of the container 40 is not strictly aligned with the groove 51.

In the embodiment of FIGS. 1*a*, 1*b*, and 1*c*, the applicator 30 is held by two separate portion in the transmission member 50.

In the embodiment of FIGS. 1*a*, 1*b*, and 1*c*, the applicator 30 has one portion (e.g., a second portion) including at least one striation 34 level with its intermediate section 33 for cooperating with a complementary relief 53 arranged level with the inner wall of the member 50. In this particular embodiment, the applicator 30 has two striations 34 and 35. Engagement of the striations 34 and 35 against the relief 53 makes it possible to prevent the applicator 30 from rotating inside the transmission member 50. The applicator 30 and transmission member 50 are therefore rotationally connected. The applicator 30 is hence rotationally connected to the container 40 via transmission member 50.

As illustrated in FIG. 1*a*, the striation 34 formed level with the intermediate section 33 has a length L1 along the axis X, and the complementary relief 53 has a length L2 along axis X. The lengths L1 and L2 are such that, when the applicator 30 is fitted in the transmission member 50, the striation 34 cooperates with the relief 53 over a sufficient length to engage the rotation, for example, over a length of more than 1 millimetre. The positioning of the striation 34 along the applicator 30, and the positioning of the relief 53 inside the member 50, are adjusted so that the striation 34 is engaged against the relief 53 only when the applicator 30 is fitted fully on the member 50.

As shown in the embodiment of FIG. 1*c*, the striation 34 is, for example, defined as being a projection at the surface of the perimeter of the applicator 30, this projection having a base B ending in an apex S, a width L3 of this projection decreasing from the base B in the direction of the apex S. The distance separating the base B from the apex S defines a height H, measured along an axis passing through a radius of the intermediate portion 33 which is, for example, cylindrical. This distance H is, for example, from 1 to several millimetres.

Optionally, the more striations 34 and 35 there are at the periphery of the applicator 30 and/or the more complementary reliefs 53 there are at the surface of the inner perimeter, the less it is for the user to show great skill and accuracy in correctly replacing the applicator 30 on the case 20 after use.

The two striations 34 and 35 are defined, in a cross-sectional view as in FIG. 1*c*, inside a circle arc of angle α less than 90°. The striations 34 and 35 may be separated or contiguous.

In the embodiment of FIGS. 1*a* and 1*b*, the intermediate portion 33 is covered over its entire outer perimeter with a plurality of thin striations, such as 34 and 35. The striations 34 and 35 are in the form of dihedra, which are distributed in such a way that the slants of two consecutive dihedra intersect level with the outer perimeter of the portion 33. The edges of these dihedra, in particular those corresponding to the junction of two consecutive dihedral slants, are parallel to the axis X. The dihedra may also be regular so that a median plane of one dihedron is radial with respect to the overall cylindrical structure of the intermediate section 33.

As depicted in the embodiment of FIG. 1*c*, an angle β is defined between two consecutive planes of two separate and consecutive dihedra and has an exemplary size of between 60° and 120°, for example, 90°. Accordingly, the relief 53 may also have a dihedral shape, elongated along the axis X and intended to be placed against striation 34. If applicator 30 has a plurality of striations 34 and 35, relief 53 engages between two consecutive striations 34 and 35. Relief 53 has a shape configured to engage in the angle β defined between two consecutive planes of two separate and consecutive dihedra.

In one variant, the applicator 30 has a single striation 34 and the inner wall of the transmission member 50 comprises a plurality of reliefs 53 arranged in continuity and level with the inner wall of transmission member 50. In such an example, the striation 34 can be engaged between two consecutive reliefs 53.

In another variant, the applicator has striations distributed continuously, or not, level with the portion 33. For example, the intermediate portion 33 may have smooth walls without any striations.

In addition to comprising a portion for rotationally coupling the applicator 30 to the container 40, the applicator 30 has a portion configured to hold the applicator in translation with respect to the case 20.

In the first embodiment of FIGS. 1*a*, 1*b*, and 1*c*, the axial holding portion (e.g., first portion) comprises a recess 36 on applicator 30 placed above the striation 34, relative to the axis X. This recess 36 is configured to cooperate with a protrusion 55, which is arranged on transmission member 50 and on the same side as opening 50*a*. This protrusion 55 may correspond, for example, to blades standing out in extension of this opening 50*a*. The blades may be slightly flexible with respect to the axis X, and each may have a radial protuberance directed towards the centre of the opening 50*a* in order to cooperate with the recess 36. Alternatively, the applicator 30 could have a collar instead of the recess 36, and this collar would then cooperate with a shoulder of the inner wall of the opening 50*a*.

In the embodiment of FIGS. 1*a*, 1*b*, and 1*c*, axial immobilisation of the applicator 30 relative to the transmission member 50 may also permit axial immobilization of the applicator 30 relative to the case 20, when this member 50 is fitted in the case 20 via the opening 21*a*.

In the embodiment of FIGS. 1*a*, 1*b*, and 1*c*, the transmission member 50 has a screw thread 54 on its outer perimeter 52 configured to cooperate with threading 23, which is provided on the inner wall of the case 20 and near the same side as the opening 21*a*.

To assemble the device 10 of FIGS. 1*a*, 1*b*, and 1*c*, the applicator 30 is inserted into the member 50 engaging striation 34 with complementary relief 53 and engaging protrusion 55 in recess 36. The connected applicator 30 and member 50 are then screwed into the case 20 via opening 21*a*. The container 40 is then inserted into case 20 via opening 21*b* and rotated to position opening 41 with lateral opening 22. As the member 50 and container 40 are fitted in the case 20, the groove 51 of the transmission member 50 cooperates with tabs 61*a* and 61*b* of the container 40 for rotationally coupling the applicator 30 with the container 40. The applicator 30, transmission member 50, and container 40 may then be rotated in the case 20 for positioning wall 43 in front of lateral opening 22, thus closing opening 22.

In the embodiment of FIGS. 1*a*, 1*b*, and 1*c*, the inner threading 23 is configured to align groove 51 with tabs 61*a* and 61*b* for "closing" opening 22 when transmission member 50 is fully screwed onto case 20. In order to access the product P provided in device 10, the applicator 30 is rotated for aligning opening 41 with lateral opening 22, which brings the container 40 into an "open" position. In this particular embodiment, the applicator 30 is rotated at least one quarter of a turn, which makes the product accessible via the lateral opening 22. Further, the applicator 30 is released from the case 20 by exerting a translational pull on the skirt, which disengages the recess 36 from the protrusion 55.

In a second embodiment, which is presented in FIG. 2, the applicator 30 has a second portion 133 with means for holding the applicator 30 axially on the case 20. This second portion 133 is arranged above the intermediate portion 33 with respect to the axis X, and has a portion for cooperating directly with threading 123 provided on the inner perimeter of the case 20; for example, it has threading complementary to that of the case 20.

According to the second embodiment of FIG. 2, the transmission member 150 is an integral part of the container 40 (e.g., they are either defined by the same piece of material or they are permanently connected to each other), and they may be obtained from the same mould. The transmission member 150 is arranged in extension along the axis X of the opening 41 of the container 40 where the product P is located. The portion 162*a* and 162*b* for holding the container 40 in translation relative to the case 20 is preferably arranged directly on this transmission member 150. To this end, the inner wall of the case 20 has a hollow, such as 64, for cooperating with these elastic locking means 162*a* and 162*b*.

In the embodiment of FIG. 2 and on inner perimeter 151, the transmission member 150 has at least one relief 153, such as 53, for cooperating with the striation 34 of the applicator 30. Because inner reliefs 153 are located at a predetermined depth with respect to opening 21*a*, when the applicator 30 is inserted into the opening 21*a* of the case 20, the screw thread 133 first engages threading 123. After the applicator 30 is at least partially screwed onto case 20, striations 34 and 35 may engage with the reliefs 153. As the applicator 30 is screwed on the case 20, the striations 34 and 35 increasingly engage with the reliefs 153. The transmission member 50 and container 40 rotate in the case 20 during at least a part of the helical rotational movement of the applicator 30. Each time the applicator 30 is screwed on or off the case 20, the position of the container 40 relative to the lateral opening 22 is predetermined and reproducible.

In order to hold the applicator 30 in the closed position on the case 20, the applicator 30 of the embodiment of FIG. 2 has a bead 136 in the form of a collar. After the applicator 30 is screwed onto case 20, bead 136 cooperates with a complementary return 124, which is arranged on the inner perimeter of the opening 21*a* of the case 20. The cooperation of the bead 136 with the return 124 provides the user with an "end-of-screwing"sensation and, in parallel, this device 10 may emit an audible signal to inform the user that the applicator 30 is attached to the case 20.

Figure 3:
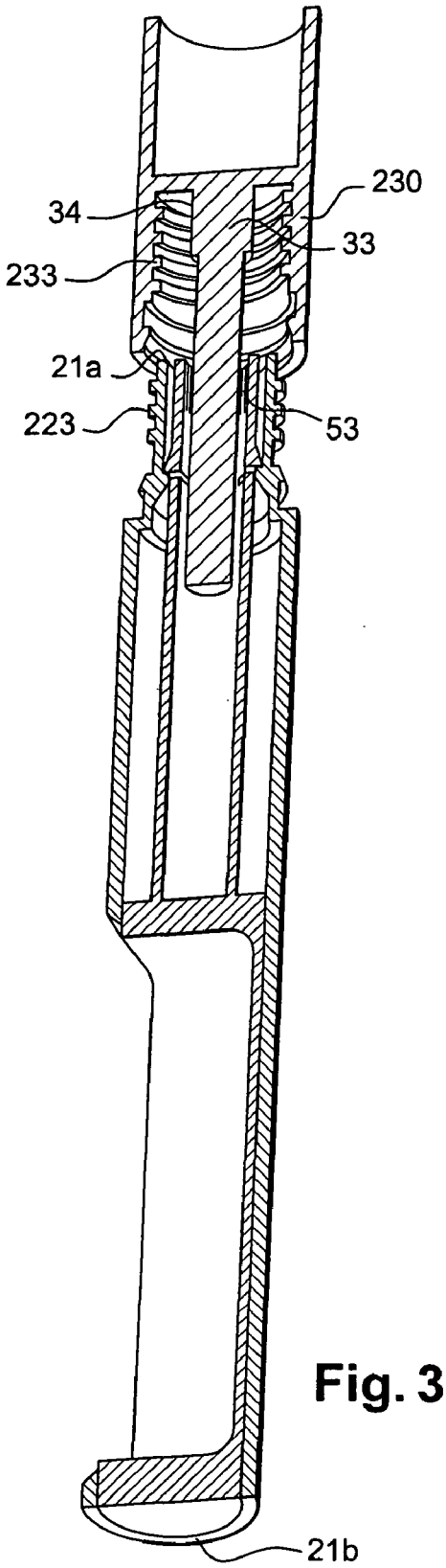
FIG. 3 shows an exploded sectional view of a device according to a third embodiment of the invention.

According to a third embodiment of the device 10, which is presented in FIG. 3, the applicator 30 comprises an intermediate portion 33 that is enclosed by a cap 230, whose walls 233 are superimposed with portion 33 along the axis X. These walls 233 have threading on an inner perimeter configured to cooperate with threading 223, which is arranged on the outer perimeter of the case 20. The applicator 30 is fitted in the opening 21*a* by first engaging the threads and bringing the cap 230 onto the case 20 by a helical movement. At the end of screwing, striation 34 cooperates with the complementary relief 53. In this particular embodiment, the striation 34 is arranged near the bottom 37 of the cap 230 relative to the axis X, whereas the complementary relief 53 intended to be arranged level with the inner wall is adjacent to the opening 21*a*.

In the embodiment of FIG. 3, after the applicator 30 is fitted on the case 20, the container 40 may be inserted in case 20 by translation via the opening 21*b*. In the embodiment of FIG. 3, the container 40 and the transmission member 50 are integrally formed as in the second embodiment of FIG. 2. As the container 40 is inserted into case 20, complementary reliefs 53 formed on the inner perimeter of the transmission member 50 engage with the at least one striation 34 of the intermediate portion 33 to rotationally couple the applicator 30 with the container 40.

As the applicator 30 is unscrewed, the container 40 rotates along with applicator 30 until the striation 34 disengages from the complementary relief 53. After the striation 34 disengages from relief 53, the container 40 is left in an "open" position irrespective of how many turns the applicator 30 subsequently executes before becoming completely unscrewed.

Figure 4C:
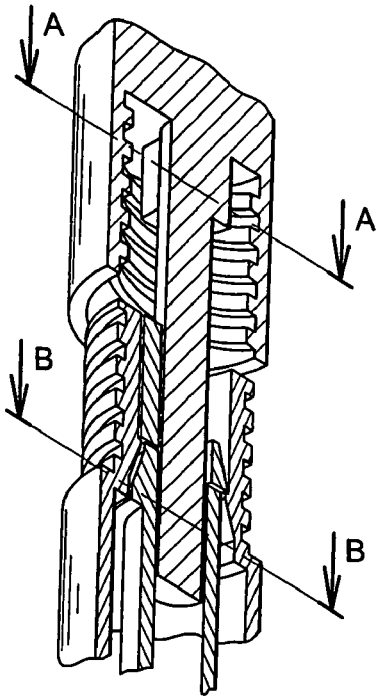
FIG. 4*c* shows an enlarged view of a junction region between the parts according to FIGS. 4*a* and 4*b;*
Figure 4B:
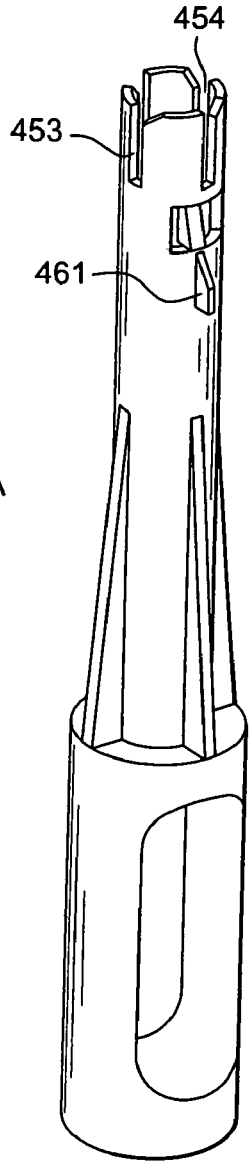
FIG. 4*b* shows an exploded sectional view of another part of a device, complementary to the part in FIG. 4*a;*
Figure 4A:
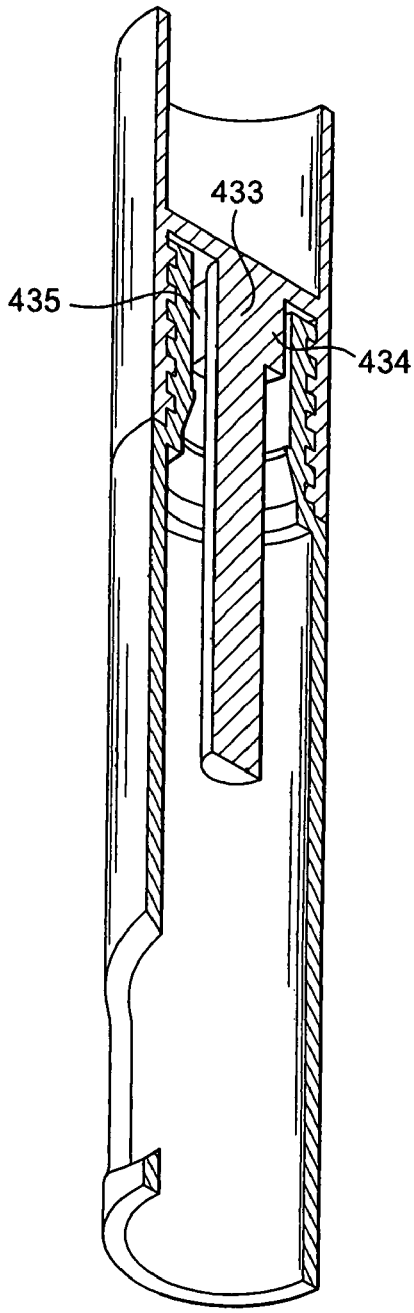
FIG. 4*a* shows an exploded sectional view of a one part of a device according to a fourth embodiment of the invention.

In a fourth embodiment depicted in FIGS. 4*a*, 4*b*, and 4*c*, the applicator 30 has a cap 230, as in the third embodiment of FIG. 3. This cap 230 has, for example, four thread entries over an inner perimeter for cooperating with four thread entries on an outer perimeter of the case 20. The pitch of these threads may be large, and full screwing of the applicator 30 onto the case 20 may be obtained with only a small number of turns. Using four thread entries permits the user to attach the applicator 30 on the case 20 with fewer rotations, for example, only a quarter of a turn.

Figure 5:
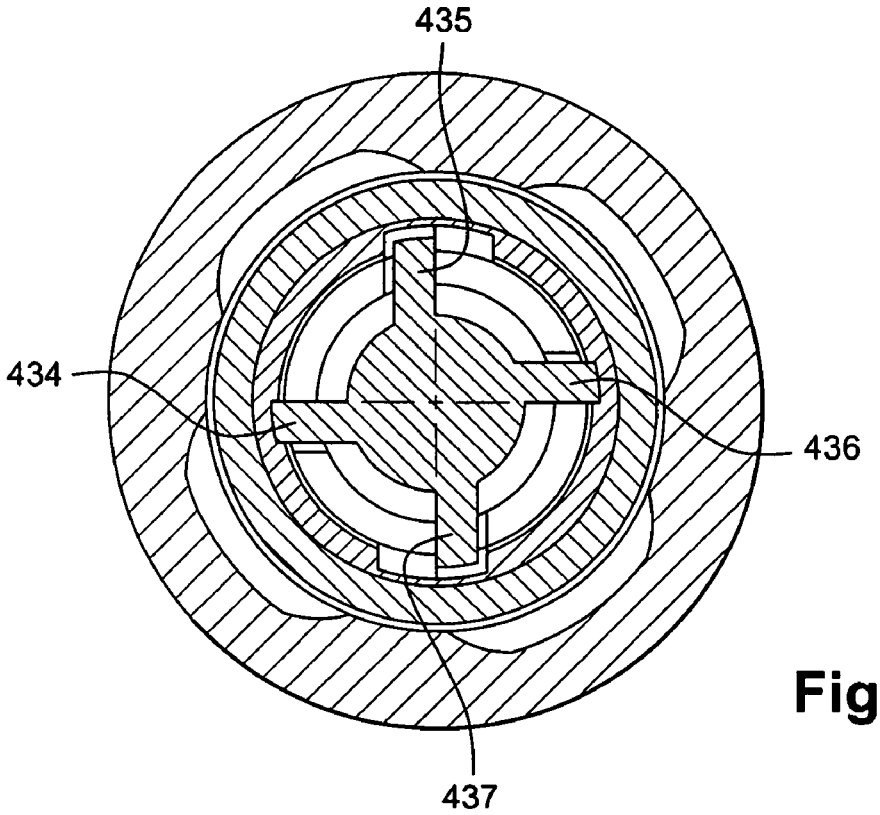
FIG. 5 shows a view on a section plane A of an assembled device according to FIG. 4*c*.

In this fourth embodiment of FIG. 4, the intermediate portion 433 has at least one striation 434, and preferably four striations—respectively 434, 435, 436, 437 (the last two depicted in FIG. 5). These four striations 434, 435, 436, and 437 are arranged at 90° with respect to one another around the axis X, at specific positions relative to the thread entries. In this particular embodiment, the striations 434, 435, 436, and 437 each have a parallelepipedal shape, the longest edges of which are parallel to the axis X.

In the embodiment of FIG. 4, the striations 434, 435, 436, and 437 are configured to cooperate with four slots, such as 453, provided on the transmission member 450, which is defined in extension of the container 40, as in the second and third embodiments. The position of the slots, such as 453, relative to the case 20 is predefined, and the container 40 has a positioning portion for cooperating with complementary portion provided on the case 20 for reproducible positioning of the container 40 relative to the case 20.

Figure 6:
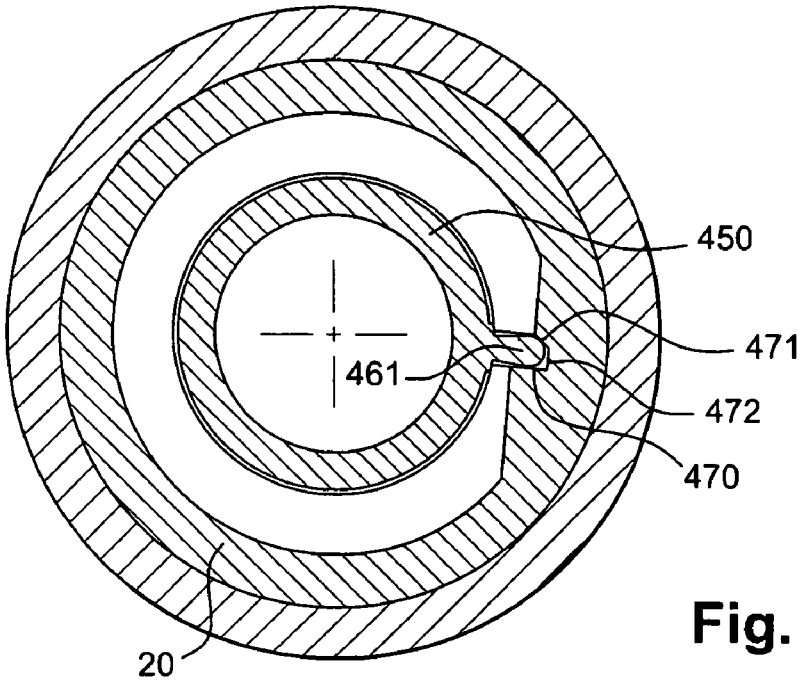
FIG. 6 shows a view on a section plane B of an assembled device according to FIG. 4*c*.

As can be seen more particularly in FIG. 6, the transmission member 450 has a portion in the form of a rib 461 parallel to the axis X The rib 461 can be positioned relative to the inner perimeter of the case 20 for limiting the rotations of the container 40 relative to the case 20. When the container 40 is in a predefined position within the case 20, the rib 461 abuts against a stop 470, which extends beyond the inner perimeter of the case 20, for limiting rotation of the container 40 within case 20. In one embodiment, the container 40 is in an "open" position when the rib 461 abuts stop 470. In order to maintain this "open" position, a provision may be made that rotation of the transmission member 450 causes the rib 461 to pass over a stud 471 of the case 20 inner perimeter. The rib 461 creates a hard-point sensation, which may be accompanied by the emission of an audible click, when the rib 461 is no longer subjected to stress and is arranged in the cavity 472, which is defined between the stud 471 and the stop 470.

The entry 454 of these slots 453 is preferably chamfered in order to provide some degree of tolerance when fitting the applicator 30 onto transmission member 450.

Before assembling the device 10, the case 20, the applicator 30, the container 40, and the transmission member 50 may be pre-manufactured. A product P may be introduced into the container 40, either directly or by means of a cup (not shown).

Of course, the invention is not limited to the embodiments which have just been described. In particular, the case 20 may be provided with shapes other than the one represented in the drawings. The applicator 30 may be fixed on the case 20 other than by screwing.

The container 40 may include several products. The container 40 may, for example, include at least two different products in at least two housings, which are accessible simultaneously or otherwise through the lateral opening 22.

Throughout the description, including the claims, the expression "a" should be understood as being synonymous with "at least one" (i.e., relating to both the singular and the plural) unless otherwise specified to the contrary.

It will be apparent to those skilled in the art that various modifications and variations can be made to the structure and methodology described herein. Thus, it should be understood that the invention is not limited to the subject matter discussed in the specification. Rather, the present invention is intended to cover modifications and variations.

What is claimed is:

1. A device for applying a product, comprising:

a container configured to contain a product;

a case comprising a compartment configured to receive the container, wherein the case defines an opening, and wherein the container is configured to be moved relative to the case between a first angular position in which product in the container is accessible via the opening, and a second angular position in which product in the container is inaccessible via the opening; and an applicator configured to be releasably coupled to the case, wherein the applicator comprises a first portion configured to contribute to restricting axial movement of the applicator with respect to the case, and a second portion distinct from the first portion, the second portion being configured to contribute to rotationally coupling the applicator to the container so that movement of the applicator causes movement of the container between the first and second angular positions, wherein the second portion comprises at least one striation extending along a length of the applicator, wherein the at least one striation has a longitudinal axis substantially parallel to a longitudinal axis of the applicator, wherein the device further comprises a transmission member, wherein the transmission member comprises at least one relief, the at least one striation cooperating with the at least one relief so that rotational movement of the applicator with respect to the case rotates the container with respect to the case, wherein the first and second portions are axially distinct from one another, wherein the applicator comprises a tip part and a skirt extending around a longitudinal axis of the tip part, wherein the skirt comprises an inner screw thread on an inner perimeter of the skirt, wherein the case comprises an outer screw thread on an outer perimeter of the case, the outer screw thread being configured to cooperate with the inner screw thread, and wherein the first portion comprises the inner screw thread.

2. A device for applying a product, comprising:

a container configured to contain a product;

a case comprising a compartment configured to receive the container, wherein the case defines an opening, and wherein the container is configured to be moved relative to the case between a first angular position in which product in the container is accessible via the opening, and a second angular position in which product in the container is inaccessible via the opening;

an applicator configured to be releasably coupled to the case;

wherein the case comprises a screw thread and the applicator comprises a helical screw thread configured to engage with the screw thread of the case, and wherein the device is configured so that movement of the applicator causes movement of the container between the first and second angular positions.

3. A device for applying a product, comprising:

a container configured to contain a product;

a case comprising a compartment configured to receive the container, wherein the case defines an opening, and wherein the container is configured to be moved relative to the case between a first angular position in which product in the container is accessible via the opening, and a second angular position in which product in the container is inaccessible via the opening;

an applicator configured to be releasably coupled to the case;

wherein the case comprises a screw thread and the applicator comprises a screw thread configured to engage with the screw thread of the case, wherein the device is configured so that movement of the applicator causes movement of the container between the first and second angular positions, and wherein the applicator comprises a skirt, wherein the screw thread of the applicator comprises an inner screw thread on the skirt, and wherein the screw thread of the case comprises an outer screw thread.

4. The device of claim 2, wherein the helical screw thread of the applicator comprises an outer helical screw thread, and wherein the screw thread of the case comprises an inner screw thread.

5. The device of claim 3, wherein the screw thread of the applicator is a helical screw thread.

* * * * *